United States Patent [19]

Carini

[11] Patent Number: 4,459,211

[45] **Date of Patent: * Jul. 10, 1984**

[54] PROCESS FOR WASTE ENCAPSULATION

[75] Inventor: Pietro T. Carini, Horgen, Switzerland

[73] Assignee: The Dow Chemical Company, Midland, Mich.

[ * ] Notice: The portion of the term of this patent subsequent to Jul. 10, 2001 has been disclaimed.

[21] Appl. No.: 376,466

[22] Filed: May 10, 1982

[51] Int. Cl.[3] ..... G21F 9/16

[52] U.S. Cl. ..... 210/751; 252/628; 252/631

[58] Field of Search ..... 210/727, 728, 730–732, 210/751, 729; 252/628, 631

[56] References Cited

U.S. PATENT DOCUMENTS

| | | | |
|---|---|---|---|
| 3,190,868 | 6/1965 | Mitacek et al. | 528/486 |
| 4,077,901 | 3/1978 | Arnold et al. | 252/628 |

*Primary Examiner*—Ivars C. Cintins

*Attorney, Agent, or Firm*—B. M. Kanuch

[57] ABSTRACT

An improvement in the process of encapsulating aqueous liquid waste materials in liquid thermosettable resins of the group consisting of vinyl ester resins, unsaturated polyester resins, and mixtures thereof, wherein the waste is emulsified in the resin, which comprises increasing the amount of waste material emulsified in a given amount of resin by incorporating in the resin-waste emulsion both a water soluble salt of carboxymethyl cellulose and a water-soluble polymeric substance containing a carbon chain having a plurality of —COOH groups or derivatives thereof.

8 Claims, No Drawings

PROCESS FOR WASTE ENCAPSULATION

BACKGROUND OF THE INVENTION

A major environmental problem centers around the disposal of various waste materials. These include radioactive wastes from nuclear fission processes, and particularly low level wastes such as those obtained from the aqueous evaporators in a nuclear power plant, used ion-exchange resins and filter materials such as clays and diatomaceous earth. These wastes may be in the form of aqueous solutions, dispersions or slurries. One method of disposing of these wastes which has proven to be quite satisfactory is described in U.S. Pat. No. 4,077,901. The process comprises the encapsulation of these waste materials in vinyl ester resins or in unsaturated polyester resins or in mixtures of these two types of resins.

The problem of waste disposal has intensified due to the costs of the incorporating materials, extreme difficulty in obtaining burial space, and the criticality of effecting uniform encapsulation of radioactive waste materials so as to avoid hot spots which lead to increased transportation and burial costs of such encapsulated wastes. Added to the foregoing is the increased complexity and variety of aqueous liquid wastes.

The Invention

The present invention is an improvement in the encapsulation of aqueous liquid waste materials in liquid thermosettable resins of the group consisting of vinyl ester resins, unsaturated polyester resins or mixtures of these resins. This improvement comprises the addition, during the encapsulation process, of both a water-soluble salt of carboxymethyl cellulose and a water-soluble polymeric substance containing a carbon chain having a plurality of —COOH groups or derivatives thereof. The purpose of adding the water soluble carboxymethyl cellulose and the water soluble polymeric substance is to increase the amount of waste material encapsulated in a given amount of resin. Such additives also permit the encapsulation of slurries or dispersions with high solids content.

This encapsulation process is described in U.S. Pat. No. 4,077,901 and comprises the emulsification of the waste material in the liquid themosettable resin. The water-soluble carboxymethyl cellulose and the water-soluble polymeric substance are added to the waste material or to the liquid thermosettable resin prior to forming the waste-resin emulsion.

Description of the Invention

The present invention is an improvement in the process described in detail in U.S. Pat. No. 4,077,901, as that process is applied to aqueous liquid wastes. The disclosure of said patent is fully incorporated herein by reference. The process of said patent broadly comprises the making of waste material-resin emulsions by blending resins, as defined in the patent, with aqueous liquid wastes. The resins used in the process are liquid thermosettable resins which include vinyl ester resins, unsaturated polyester resins and mixtures of these resins. The vinyl ester resins that may be employed are more particularly defined in the claims as liquid thermosettable resin compositions of (1) a vinyl ester resin prepared by reacting about equivalent proportions of an unsaturated monocarboxylic acid and a polyepoxide resin, said vinyl ester resin containing

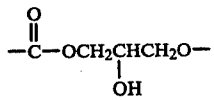

linkage groups and terminal vinylidene groups attached to the ester end of said linkage, or (2) an unsaturated polyester, or (3) mixtures thereof, and a catalyst for curing said resin. The composition is cured under thermal and catalytic conditions such that the exotherm developed during the cure never rises above the temperature at which the integrity of the encapsulating material is destroyed. Vinyl ester resins are further described in U.S. Pat. Nos. 3,367,992; 3,066,112; 3,179,623; 3,301,743; and 3,256,226.

Preferably, the thermosettable resin phase comprises from 40 to 70 weight percent of the vinyl ester or polyester resin and from 60 to 30 percent of a copolymerizable monomer. Suitable monomers must be essentially water insoluble to maintain the monomer in the resin phase in the emulsion, although complete water insolubility is not required. A small amount of monomer dissolved in the emulsified water does no harm.

Suitable monomers include vinyl aromatic compounds such as styrene, vinyl toluene, divinyl benzene, and the like, and the saturated alcohols such as methyl, ethyl, isopropyl, octyl, etc., esters of acrylic acid or methacrylic acid; vinyl acetate; diallyl maleate; dimethallyl fumarate; mixtures of the same and all other monomers which are capable of copolymerizing with the vinyl ester resin and are essentially water insoluble.

Still another group of vinyl ester resins that may be employed are those modified by reaction with dicarboxylic acid anhydrides.

The unsaturated polyester resins that may be used in the process are described in column 3 of U.S. Pat. No. 4,077,901. Such polyesters are made by reacting ethylenically unsaturated dicarboxylic acids or anhydrides with an alkylene glycol or polyalkylene glycol having a molecular weight of up to about 2,000.

Mixtures of the vinyl ester and the unsaturated polyester resins may be employed.

In practicing the method of the invention covered by U.S. Pat. No. 4,077,901, a free radical yielding catalyst is blended with the resin and the waste material is then dispersed in the resin under conditions to form a uniform emulsion. The wastes treatable according to the present invention are aqueous liquids, either as solutions or slurries, which form liquid waste-in-resin emulsions. These emulsions are classified as the water-in-oil type. In such instances, the aqueous liquid waste is added to the liquid uncured resin under shearing conditions to form the emulsion. While the shear conditions may be widely varied, generally with aqueous liquid wastes, sufficient shear should be applied to produce a relatively uniform emulsion of small droplet size. The emulsion should have sufficient storage stability to last through the initial gelation of the resin.

Catalysts that may be used for the curing or polymerization are preferably the peroxide and hydroperoxide catalysts such as benzoyl peroxide, lauroyl peroxide, t-butyl hydroperoxide, methyl ethyl ketone peroxide, t-butyl perbenzoate, potassium persulfate and the like. The amount of catalyst added will vary preferably from 0.1 to about 5 percent by weight of the resin phase. Additional catalyst may be required for certain wastes.

Preferably, the cure of the emulsion can be initiated at room temperature by the addition of known accelerating agents or promoters, such as lead or cobalt naphthenate, dimethyl aniline, N,N-dimethyl-p-toluidine and the like, usually in concentrations ranging from 0.1 to 5.0 weight percent. The promoted emulsion can be readily gelled in about 3 to 15 minutes, depending on the temperature, the catalyst level and the promoter level, and cured to a hard solid in about one hour.

It is important in the process of encapsulating aqueous liquid wastes that the conditions of selection of catalyst, catalyst concentration and promoter selection and concentration be such that the exotherm does not rise above the temperature at which the integrity of the encapsulating material will be destroyed.

The present invention comprises an improvement in the encapsulating process described and claimed in U.S. Pat. No. 4,077,901. The amount of aqueous liquid waste that can be encapsulated in the resin in the practice of the process of said patent varies widely with the particular waste involved. The addition of a water-soluble polymeric substance (exemplified by the TAMOLS, a trade name of Rohm & Haas, Inc.) in the encapsulation process will in many instances increase the waste to resin ratio to 2:1 or higher (note U.S. patent application Ser. No. 164,424, filed June 30, 1980). The addition of a water-soluble salt of carboxymethyl cellulose has shown a surprising increase in the waste to resin ratio when used with certain problem wastes. This improvement is disclosed and claimed in U.S. patent application Ser. No. 376,467, filed concurrently with the instant application. Still there are certain aqueous liquid wastes which are so difficult to encapsulate in resin that, even with the addition of either one of the above-mentioned additives, the waste to resin ratio may not rise above 1:1.

The present invention resides in the discovery that the combination of both the water-soluble salt of carboxymethyl cellulose with the water-soluble polymeric substance (as defined hereafter) produces, in many instances, a synergistic effect wherein the amount of aqueous liquid waste that can be encapsulated in the resin may increase, e.g., to twice as much by weight as the resin binder itself. This is particularly true with aqueous dispersions or slurries containing sodium, iron, calcium and aluminum salts, oxalic acid, citric acid, diatomaceous earth, water slurries of ion-exchange resins and filter aid materials.

The water-soluble polymeric substances employed in the present invention broadly encompass those water-soluble polymeric substances which contain a carbon chain having a plurality of —COOH groups, and derivatives thereof. These extenders or additives and methods of making same are described in detail in U.S. Pat. No. 3,190,868. Preferably, these polymeric substances comprise anionic compounds having a low acid functionality. The molecular weights of these polymers as determined by the Rast method may vary from 500 to 10,000, although lower molecular weights in the order of 800 to 3,000 are preferred. Optimum results have been obtained with water-soluble copolymers of a 1-olefin containing 4 to 16 carbon atoms and a compound selected from the group consisting of

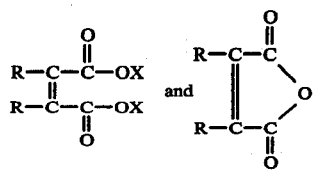

where each R is individually selected from the group consisting of hydrogen, methyl and ethyl and X is individually selected from the group consisting of hydrogen, methyl, ethyl, propyl, butyl, ammonium and alkali metal. The preferred 1-olefins are those containing 6 to 10 carbon atoms, and diisobutylene has been found to produce polymers particularly effective in the process of the present invention.

Carboxyl containing compounds having the generic formula of the anhydrides shown above are preferred in the production of these water-soluble polymeric substances and particularly maleic anhydride. As noted in U.S. Pat. No. 3,190,868, copolymers of diisobutylene and maleic anhydride are well known in the art, and are also disclosed and described in U.S. Pat. No. 2,378,629. Particularly outstanding results have been achieved in the practice of the present invention with the use of polymeric substances which comprise a copolymer of diisobutylene and maleic anhydride in approximately equal proportions and having a molecular weight of about 1,500. This material, in the form of the sodium salt is available commercially under the trademark "TAMOL-731", a product of the Rohm and Haas Company; and in the form of the ammonium salt, as "TAMOL-165", which is of slightly higher molecular weight than "TAMOL-731". DAXAD-31, a trademark product commercially available from W. R. Grace is essentially similar to the above.

The water soluble salt of carboxymethyl cellulose employed in conjunction with the above-described polymeric substance, is referred to generally as "CMC". The commercial product is the sodium salt of carboxymethyl groups substituted on the cellulose molecule. There is a theoretical maximum of three hydroxyl groups in the cellulose molecule that may be so substituted, but CMC having a degree of substitution ranging from about 0.65 to about 1.2 is preferred in the practice of the present invention.

In practicing the improved process comprising this invention, either or both the water-soluble polymeric substance and CMC may be incorporated in the waste or in the resin prior to forming the waste-resin emulsion. It follows that one additive may be added to the waste and the other to the resin. The addition of CMC to aqueous liquids tends to greatly increase the viscosity of the mixture. With most waste materials tested, the addition of the CMC and the water-soluble polymeric substance to the resin before incorporating the waste therein produced more uniform, lower viscosity emulsions and better encapsulation than any of the other procedures tried. Neither the CMC nor the polymeric substance is soluble in the resin phase, so that the addition of these additives to the resin must be accomplished by means of sufficient stirring to obtain a uniform dispersion of these additives throughout the resin.

One very pragmatic reason for adding both additives to the resin is that many waste materials, such as those that are radioactive, are very hazardous to handle. Consequently, incorporating both additives in the resin removes two hazardous steps from the overall process.

Verification or test runs are made to determine optimum amounts of the above-mentioned additives and appropriate ratios of aqueous liquid waste to resin. Before any verification runs are made practicing the present invention, tests are made with the particular waste or slurry under consideration using first the resin alone. Then the addition of the water-soluble polymeric substance and finally CMC. If none of these tests succeed in producing satisfactory encapsulation of the waste by the resin in ratios at least equal to 1:1 waste to resin, then verification runs are made wherein both the polymeric substance and CMC are added to the resin.

Emulsions made of aqueous liquid waste materials and resins are usually of a creamy consistency. When the amount of waste added exceeds the ability of the resin to emulsify the waste, water streaks are produced which swirl about the vortex created by the stirrer. These streaks are of a different consistency from the rest of the dispersion and sometimes of a different color. This water streak end point is of considerable significance, since water-in-oil type emulsions of waste and resin which contain water streaks usually produce a hardened encapsulated product which has free water on its surface. Such a product is not acceptable for burial.

The addition of CMC tends to mask the true end point (maximum amount of waste that can be encapsulated in a given amount of resin) at waste to resin ratios above about 1:1. Occasionally, a reduction in viscosity can be noted at or near the end point. For verification purposes, however, the catalyst and promoter must be added to the final emulsion, the emulsion gelled and a solid block obtained. Only then can it actually be determined whether the conditions producing this particular emulsion can be used in commercial practice of the invention.

For the above reasons, verification tests using the present invention may require a number of test runs using knowledge gained from separate tests on a given waste or slurry with CMC and the polymeric substance. Preferred amounts of CMC and the polymeric substance are sequentially incorporated in the resin with stirring. Usually these starting amounts are in the range of 2 to 4 grams of CMC and 4 to 6 milliliters of a 25% solution of the polymeric substance such as TAMOL-731. Waste is added until water streaks or a break in the viscosity is noted. The test is repeated with varying amounts of additives until the maximum waste to binder ratio is determined.

It shoud be noted that the incorporation of water-soluble polymeric substances and the CMC in the water-in-oil emulsion does not adversely affect the amount of catalyst or promoter that is required for effective cure of the resin, nor does it adversely affect the exothermic temperature produced during such cure beyond that which one skilled in the art can easily make appropriate adjustments.

The amount of CMC and polymeric substance used in practicing the invention will vary widely with the type of waste to be encapsulated, the particular resin used and to some extent on the shear achieved by the mixing equipment. More of either additive is not necessarily better. In fact, very large amounts of either additive, in the presence of only small amounts of or zero amounts of the other additive, may cause the emulsion to invert, i.e., to produce an oil-in-water emulsion as opposed to the water-in-oil (or resin) emulsion required for encapsulation of the waste. When this occurs, water streaks usually appear or a reduction in the viscosity of the emulsion is noted. In actual practice it has been found that a certain balancing of the amounts of these additives is desirable. For example, especially high waste to resin ratios in the encapsulation process are achieved when roughly one milliliter of a 25% aqueous solution of the polymeric substance is used for each gram of the dry solid CMC. Based on the resin used, the polymeric substance may preferably vary from 0.25 to 3.0% by weight of the resin present. The CMC used with the polymeric substance may preferably vary, based on the resin used, from 0.5 to 10% by weight of the resin present.

In addition to significantly increasing the amount of waste that can, in many instances, be encapsulated in the resin with either additive alone, the combination of CMC with the named polymeric substances satisfactorily encapsulates problem waste slurries having solids content in the range of 85%.

The method of the present invention is illustrated in the following Examples which include comparative formulations for purposes of illustrating the present invention. All parts and percentages shown in this specification and claims are by weight unless otherwise indicated. In the following examples:

(1) Resin A is a fluid thermosettable resin which is prepared by reacting 32.6 parts of the diglycidyl ether of bisphenol A extended with 8.7 parts of bisphenol A; then reacted with 1.2 parts maleic anhydride and 7.5 parts methacrylic acid, the resin dissolved in 50 parts styrene.

(2) Resin B is a fluid thermosettable, polyester resin obtained from Interplastics Corp., under the trade designation COREZYN 158-5. Additional styrene was added to bring the styrene concentration to 40% of the total resin.

(3) Catalyst is 40 percent benzoyl peroxide emulsified in diisobutyl phthalate obtained from Noury Chemical Corp. under the trade designation CADOX 40E.

(4) Promoter is N,N-dimethyl-p-toluidine.

(5) Additive designated "TAMOL" is 25 percent TAMOL-731 in water.

(6) Additive designated "CMC" is the water-soluble sodium salt of carboxymethyl cellulose having a degree of substitution ranging from 0.65 to 0.90 medium viscosity and a molecular weight in the range of 250,000, obtained from the Hercules Chemical Co. under the designation "CMC-7M".

EXAMPLE 1

For comparison purposes, a simulated aqueous liquid waste slurry was prepared by mixing uniformly the following solids in the amounts shown in water:

| | |
|---|---|
| Powdered Ion Exchange Resin (cation) | 2,000 gms |
| Powdered Ion Exchange Resin (anion) | 2,000 gms |
| Filter Precoat (cellulosic material) | 1,000 gms |
| Used Turbine Oil | 150 gms |
| Water | 10,000 gms |
| (approximately 85% apparent solids) | |

Solidification was attempted using the following formulations, which differ only in respect to the quantity of waste slurry added and the presence or absence of the named additives:

| Formulation | 1A | 1B | 1C |
|---|---|---|---|
| Resin A | 100 mls | 100 mls | 100 mls |
| TAMOL | — | 4 mls | — |
| CMC | — | — | 4 gms |
| Slurry | 45 mls | 125 mls | 170 mls |
| Catalyst | 2.5 mls | 2.5 mls | 2.5 mls |
| Promoter | 0.15 ml | 0.15 ml | 0.15 ml |

In Example 1A, the slurry was added to the Resin A with rapid stirring to maintain a vortex in the center of the stirred mixture. Initial addition of the slurry produced an off-white, water-in-oil emulsion which increased in viscosity as the slurry was added. After 45 milliliters of slurry were added, liquid (water) streaks were noted in the emulsion. Addition of the slurry was then discontinued and the catalyst and then the promoter were added.

Following the addition of the catalyst and promoter, the emulsion gelled in about 8 minutes and reached a peak temperature of 100° C. in about 1 hour, producing a tan, hard block.

In Example 1B, the same procedure was followed as with Example A with the single exception that TAMOL was thoroughly incorporated by stirring in Resin A prior to addition of the resin of the slurry. After 125 milliliters of slurry had been added, water streaks were noted in the emulsion and the addition of slurry was discontinued. Following the addition of the catalyst and the promoter, the emulsion gelled in about 4 minutes and reached a peak temperature of about 60° C. in about 1 hour, producing a tan, hard block with some surface water.

In Example 1C, the procedures described in Example 1A were used with the exception that CMC was thoroughly incorporated by stirring in Resin A prior to the addition of slurry to the resin. After 170 milliliters of slurry had been added, water streaks were noted in the emulsion and the addition of slurry was discontinued. Following the addition of the catalyst and the promoter, the emulsion gelled in about 3 minutes and reached a peak temperature of 53° C. in less than one hour, producing a hard, tan block.

EXAMPLE 2

Using the simulated slurry of Example 1, the following formulation incorporating both the TAMOL and CMC was prepared:

| Formulation | 2A |
|---|---|
| Resin A | 100 mls |
| TAMOL | 4 mls |
| CMC | 4 gms |
| Slurry | 210 mls |
| Catalyst | 2.5 mls |
| Promoter | 0.15 ml |

Following the procedures of Examples 1B and 1C, the TAMOL and CMC were both incorporated with stirring into Resin A. Gel time for the catalyzed and promoted emulsion was 2.45 minutes, the maximum temperature during polymerization was 43° C. A hard, tan block was obtained that was free from water.

EXAMPLE 3

Following the procedures of Examples 1 and 2, as well as the same slurry, tests were made using Resin B in the following formulations:

| | 3A | 3B | 3C | 4D |
|---|---|---|---|---|
| Resin B | 100 mls | 100 mls | 100 mls | 100 mls |
| TAMOL | — | 8 mls | — | 12 mls |
| CMC | — | — | 6 gms | 6 gms |
| Slurry | 40 mls | 78 mls | 80 mls | 123 mls |
| Catalyst | 2.5 mls | 2.5 mls | 2.5 mls | 2.5 mls |
| Promoter | 0.1 ml | 0.1 ml | 0.1 ml | 0.1 ml |
| Gel Time (minutes) | — | 3.75 | — | 3 |
| Maximum Temperature (°C.) | — | 88 | — | 70 |

Example 3A showed water streaks when 40 milliliters of slurry had been added. When additional slurry was added, the emulsion inverted.

Example 3B produced a good solid block with no free standing water.

In Example 3C the emulsion inverted and, even though the solids flocculated, no solid block was obtained.

A good solid block free from standing water was obtained in Example 3D, showing a marked increase in the amount of slurry that could be successfully encapsulated in a given amount of resin when both TAMOL and CMC were added.

EXAMPLE 4

Following procedures of Examples 1 and 2, 6 grams of various CMC compounds (described below) were mixed with 100 milliliters of Resin A, 8 milliliters of TAMOL, 200 milliliters of the slurry described in Example 1, 2.5 milliliters of catalyst and 0.1 milliliter of promoter. The following sodium carboxymethyl celluloses were used:

CMC-7M-a medium viscosity CMC having a degree of substitution of about 0.7 and a molecular weight of about 250,000.

CMC-7M8S-same as CMC-7M but also having 8000 centipoises maximum viscosity in a 1% solution, having smooth solution characteristics.

CMC-12M8-a medium viscosity CMC having a degree of substitution of about 1.2 and 8000 centipoises maximum viscosity in 1% solution.

In each instance the catalyzed and promoted emulsion formed a hard, solid block with no free standing water. Gel time and maximum temperatures during polymerization for each run are tabulated below.

| Example No. | CMC | Gel Time (minutes) | Maximum Temperature °C. |
|---|---|---|---|
| 4A | CMC-7M | 8.5 | 53 |
| 4B | CMC-7M8S | 8.3 | 52 |
| 4C | CMC-12M8 | 6 | 57 |

Example 5

A radioactive slurry purporting to have the same or similar composition to the slurry described in Example 1 was tested. Using the procedures described in Example 1, attempts to encapsulate this slurry in Resin A, without any additives, resulted in the encapsulation of less than 1 part of slurry for each part Resin A. The addition of TAMOL increased the slurry/resin ratio to 1.2:1. When both TAMOL and CMC were added to the binder, the following results were obtained:

| | 5A | 5B |
|---|---|---|
| Resin A | 50 mls | 50 mls |
| CMC | 3.0 gms | 3.0 gms |
| TAMOL | 4.0 mls | 4.0 mls |
| Radioactive Slurry (73% Solids) | 112 mls | — |
| Radioactive Slurry (85% Solids) | — | 115 mls |
| Catalyst | 1.3 mls | 1.5 mls |
| Promoter | 0.25 ml | 0.25 ml |
| Gel Time (minutes) | 7.25 | 7.0 |
| Maximum Temperature (°C.) | 55 | 55.5 |
| Slurry/Resin ratio | 2.24:1 | 2.3:1 |

In each instance a solid block was obtained that was free from water. The combined addition of TAMOL and CMC produced major increases of slurry encapsulated in a given amount of Resin A. Furthermore, Resin A alone could only encapsulate slurries having up to 63% apparent solids, while those formulations containing both TAMOL and CMC encapsulated slurries having 85% apparent solids with no difficulty.

Example 6

Using the simulated slurry of Example 1, TAMOL was dispersed in Resin A and CMC was dispersed in the slurry, in the amounts designated below:

| Formulation | 6A | 6B |
|---|---|---|
| Resin A | 100 mls | 100 mls |
| TAMOL | 8 mls | 8 mls |
| Slurry | 200 mls | 205 mls |
| CMC | 3 gms | 6 gms |
| Catalyst | 3 mls | 2.5 mls |
| Promoter | 0.5 ml | 0.35 ml |
| Gel Time (minutes) | 2 | 2.5 |
| Maximum Temperature (°C.) | 64 | 62 |

The resin with TAMOL dispersed therein and the slurry containing the CMC were emulsified with shearing stirring until water streaks were barely evident. Upon the addition of the catalyst and promoter as described in the above examples, the emulsion gelled in the times indicated and formed a white, hard block in about one hour.

Example 7

A simulated boiling water reactor waste was prepared by uniformly mixing the following ingredients in sufficient water to make up one liter of waste:

| Ingredient | Grams/Liter |
|---|---|
| NaCl | 50 |
| $Na_2SO_4$ | 31.7 |
| $Na_3PO_4.12H_2O$ | 46 |
| $FeSO_4.2H_2O$ | 80 |
| $CaSO_4.2H_2O$ | 3.4 |
| Diatomaceous Earth | 10 |
| $Al_2O_3$ | 4 |
| KOH | 40 |
| Oxalic Acid | 20 |
| Citric Acid | 20 |
| Detergents | 0.74 |

Encapsulation of this waste was then attempted in the following formulations:

| Formulation | 7A | 7B | 7C | 7D |
|---|---|---|---|---|
| Resin A | 50 mls | 50 mls | 50 mls | 50 mls |
| TAMOL | — | 4 mls | — | 2 mls |
| CMC | — | — | 4 gms | 2 gms |
| Waste | 35 mls | 43 mls | 100 mls | 100 mls |
| Catalyst | 1.2 mls | 1.2 mls | 1.2 mls | 1.2 mls |
| Promoter | 0.05 ml | 0.05 ml | 0.05 ml | 0.05 ml |
| Gel Time (minutes) | 7.75 | <12 | 11.75 | 3.75 |
| Maximum Temperature °C. | 73 | 57 | 41 | 44 |

The procedure recited above in connection with Examples 1A, 1B and 1C were employed with Examples 7A, 7B and 7C, respectively. The procedures of Example 2A, above, were used in connection with Example 7D.

In Example 7A, the waste was added until water streaking was apparent. However, a good solid block was obtained following gelation of the formulation with no free water visible.

Waste was added in Example 7B until some streaking was noticed. Again, a good, solid block was obtained following gelation that was free from surface water.

When CMC was added in Example 7C, the stirred emulsion became lumpy after 37 milliliters of waste had been added. As additional waste was added, the viscosity of the emulsion decreased indicating a change in the nature of the emulsion. Streaking did not appear until 100 milliliters of waste had been added. By then it was apparent that CMC had masked the true end-point, the maximum amount of waste that could be encapsulated in resin. This fact was confirmed after the catalyst and promoter had been added and a hard block was not obtained.

In Example 7D both CMC and TAMOL were added to the resin. 100 Milliliters of waste was added, followed by the catalyst and promoter. The emulsion gelled in 3 minutes 45 seconds, and a good, hard block free from surface water was obtained in less than one hour.

What is claimed is:

1. In the process of encapsulating wastes in liquid thermosettable resins of the group consisting of vinyl ester resins, unsaturated polyester resins and mixtures thereof, wherein the waste is emulsified in the resin, the improvement which comprises incorporating in the waste-resin emulsion both a water-soluble polymeric substance containing a carbon chain having a plurality of —COOH groups and derivatives thereof, and a water-soluble salt of carboxymethyl cellulose.

2. In the process of encapsulating aqueous liquid wastes in liquid thermosettable resins of the group consisting of vinyl ester resins, unsaturated polyester resins and mixtures thereof, wherein the waste is emulsified in the resin, the improvement which comprises incorporating in the waste-resin emulsion both a water-soluble salt of carboxymethyl cellulose and a water-soluble copolymer of a 1-olefin containing 4 to 16 carbon atoms and a compound selected from the group consisting of

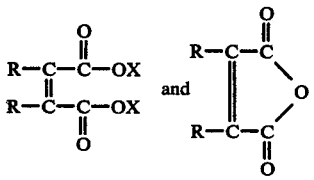

where each R is individually selected from the group consisting of hydrogen, methyl and ethyl and X is individually selected from the group consisting of hydrogen, methyl, ethyl, propyl, butyl, ammonium and an alkali metal.

3. The process of claim 2 wherein both the carboxymethyl cellulose and the water soluble polymer are incorporated in the resin prior to the emulsification of the water.

4. The process of claim 2 wherein carboxymethyl cellulose has a degree of substitution ranging from about 0.65 to about 1.2 and the compound selected from the group in the production of the copolymer is

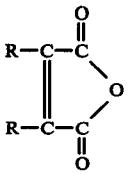

5. The process of claim 4 wherein the 1-olefin is diisobutylene.

6. In the process of encapsulating aqueous liquid wastes in liquid thermosettable resins of the group consisting of vinyl ester resins, unsaturated polyester resins and mixtures thereof, wherein the liquid waste is emulsified in the resin, the improvement which comprises incorporating in the resin prior to the incorporation of the waste both a sodium carboxymethyl cellulose and a water-soluble copolymer of a 1-olefin containing 4 to 16 carbon atoms and an anhydride having the formula

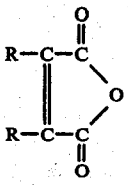

wherein each R is individually selected from the group consisting of hydrogen, methyl and ethyl, said copolymer having a molecular weight of from about 500 to 10,000.

7. The process as defined in claim 6 wherein the water-soluble copolymer is the sodium salt thereof, the 1-olefin is diisobutylene and the copolymer has a molecular weight of from about 800 to 3,000.

8. The process as defined in claim 6 wherein the sodium carboxymethyl cellulose has a degree of substitution ranging from about 0.65 to about 0.90 and the water-soluble copolymer is a copolymer of maleic anhydride and diisobutylene.

* * * * *

UNITED STATES PATENT AND TRADEMARK OFFICE

CERTIFICATE OF CORRECTION

PATENT NO. : 4,459,211

DATED : July 10, 1984

INVENTOR(S) : Pietro T. Carini

It is certified that error appears in the above-identified patent and that said Letters Patent is hereby corrected as shown below:

Col 1, line 48, "themosettable" should read -- thermosettable --.

Col 5, line 51, "shoud" should read -- should --.

Col 7, line 28, "of the resin" should read -- to the resin --.

Col 10, line 12 (in the Table under 7B, opposite Gel Time (minutes)) " <12" should read --> 12 --.

Signed and Sealed this

*Nineteenth* Day of *February 1985*

[SEAL]

*Attest:*

DONALD J. QUIGG

*Attesting Officer*

*Acting Commissioner of Patents and Trademarks*

Disclaimer and Dedication 4,459,211.—*Pietro T. Carini,* Horgen, Switzerland. PROCESS FOR WASTE ENCAPSULATION. Patent dated July 10, 1984. Disclaimer and Dedication filed Dec. 18, 1989, by the assignee, The Dow Chemical Company.

Hereby disclaims and dedicates to the Public all claims of said patent.

[*Official Gazette April 10, 1990* ]